US006095508A

United States Patent [19]

Baraldi et al.

[11] Patent Number: 6,095,508

[45] Date of Patent: Aug. 1, 2000

[54] VICE DEVICE

[75] Inventors: Alfredo Baraldi, Modena, Italy; Jean Mazingue, Pierry, France

[73] Assignee: Virax S.A., Epernay, France

[21] Appl. No.: 08/874,574

[22] Filed: Jun. 12, 1997

[30] Foreign Application Priority Data

Jun. 13, 1996 [FR] France ..... 96 07509
Feb. 11, 1997 [FR] France ..... 97 01708

[51] Int. Cl.[7] ..... B25B 1/08

[52] U.S. Cl. ..... 269/97; 269/236; 269/212

[58] Field of Search ..... 269/236, 212, 269/214, 215, 188, 194, 97, 98

[56] References Cited

U.S. PATENT DOCUMENTS

| | | | |
|---|---|---|---|
| 636,661 | 11/1899 | Guest | 269/212 |
| 1,084,489 | 1/1914 | Schmutz | 269/236 |
| 1,186,671 | 6/1916 | McKenzie | 269/212 |
| 2,788,688 | 4/1957 | Atkins . | |
| 4,475,726 | 10/1984 | Smith | 269/236 |
| 4,729,552 | 3/1988 | Pempek . | |
| 5,172,896 | 12/1992 | Beere . | |

FOREIGN PATENT DOCUMENTS

| | | |
|---|---|---|
| 656245 | 6/1995 | European Pat. Off. . |
| 44415 | 8/1888 | Germany . |
| 313092 | 9/1919 | Germany . |
| 374958 | 5/1923 | Germany . |
| 247792 | 12/1945 | Switzerland . |

OTHER PUBLICATIONS

French Search Report dated Jan. 31, 1997 of French application No. 96/07509.

*Primary Examiner*—David A. Scherbel
*Assistant Examiner*—Benjamin M. Halpern
*Attorney, Agent, or Firm*—Young & Basile, PC

[57] ABSTRACT

A vice device consisting of a frame containing a fixed jaw and a rack, the rack being placed in a plane perpendicular to the fixed jaw; and a mobile jaw, containing a body and a jaw mobile in movement compared to the body. The jaw is mobile in movement parallel to the rack with the possibility of locking onto the rack by means of a rack mobile in the body equipped with notches at its end opposite the rack and biased in the direction of rack by at least one spring and maneuverable by a lever connected to the body. The end of the body connected to the lever being linked to a cam which leans on the posterior part of the mobile jaw in order to allow the spreading of the mobile jaw compared to the body in the direction of the fixed jaw.

11 Claims, 6 Drawing Sheets

VICE DEVICE

BACKGROUND OF THE INVENTION

This invention relates to vice devices.

A vice is generally composed of two jaws, one fixed and the other mobile, and of a means of moving the mobile jaw in order to achieve tightening, the means consistent in most cases with a screw-nut system. In use, the object to be tightened is placed against the fixed jaw and the mobile jaw is brought into contact with the object by making the screw turn by means of a lever.

To successively tighten objects of different dimensions, it is necessary, before the tightening operation, to adapt the spread of the jaws by contracting them or spreading them in such a way that the tightening of the object cannot be performed immediately.

The goal of the present invention is to remedy this inconvenience by proposing a vice device allowing an immediate tightening by not requiring the pre-adjustment of the spread of the jaws.

SUMMARY OF THE INVENTION

The vice device of the invention is characterized by a frame fixed onto a flat support and including a fixed jaw and a rack, the rack being placed in a plane perpendicular to the fixed jaw, and a mobile jaw containing a body and a jaw mobile in movement compared to the body. The jaw is also mobile in movement parallel to the rack with the possibility of locking onto the rack by means of a mobile driver in the body equipped with notches at its end opposite to the rack. The mobile jaw is brought back in the direction of mobile driver by at least one spring and maneuverable by a lever attached to the body. The attached end of the lever is linked to a cam which leans on the posterior part of the mobile jaw in order to allow the spreading of the mobile jaw in relation to the body in the direction of the fixed jaw.

According to the first method of production of the device of this invention, first, the body and the jaw of the mobile jaw are connected to an axis parallel to the jaw, and second, the rack is formed in the shape of a circular arc coaxial to the axis.

According to an additional characteristic of the first method of production of the device of this invention, the mobile driver is lodged in a radial chamber in the pivoting axis of the mobile jaw and is pushed back in the direction of the rack by a spring. The mobile driver is linked to the cam in such a manner that rotation of the mobile driver, in the direction opposite to that which permits the spreading of the mobile jaw from the body, leads to compression of the spring.

According to another additional characteristic of the device of this invention, the cam consists of a half circle, non-coaxial to its pivoting axis, of which one part is inscribed in an indentation pierced in the central region of the driver, the curved side coming into contact with the mobile jaw, while the flat side is likely to come to push against the upper side of the indentation.

The pivoting of the cam by means of the maneuvering lever allows, in one direction of rotation, the disengaging of the driver from the rack and the pivoting of the body and the mobile jaw in the direction of the fixed jaw in order to lock the object to tighten and, in the opposite direction, the engagement of the driver onto the rack for locking of the body and, by prolonging the movement, the spreading of the mobile jaw from the body, so that its nearing to the fixed jaw achieves the tightening of the object.

According to a second method of production of the device of this invention, the mobile jaw is mounted slidingly in parallel to a straight rack by means of guides fixed to the body of the mobile jaw, while the mobile jaw is made mobile by sliding on the guides.

According to an additional characteristic of the second method of production of the device of this invention, the guides are tubular pieces which slide on parallel bars fixed to the frame.

In accordance with the invention, the cam is fixed in rotation to the lever by means of a retractable lug in the lever.

The two methods of production are not destined to the same uses because of different kinematics of the mobile jaws, the first method being more particularly designed to tighten cylindrical objects, such as tubes, while the second permits the tightening of flat objects. Also, the jaws of the first method of production preferably have a V-shaped cross-section, one concave and the other convex, while the jaws of the second method of production are flat.

BRIEF DESCRIPTION OF THE DRAWINGS

The advantages and characteristics of the invention will come out more clearly in the following description, which describes the attached drawings representing several non-limiting embodiments thereof.

In the attached drawing.

DESCRIPTION OF THE PREFERRED EMBODIMENTS

Figure 1:
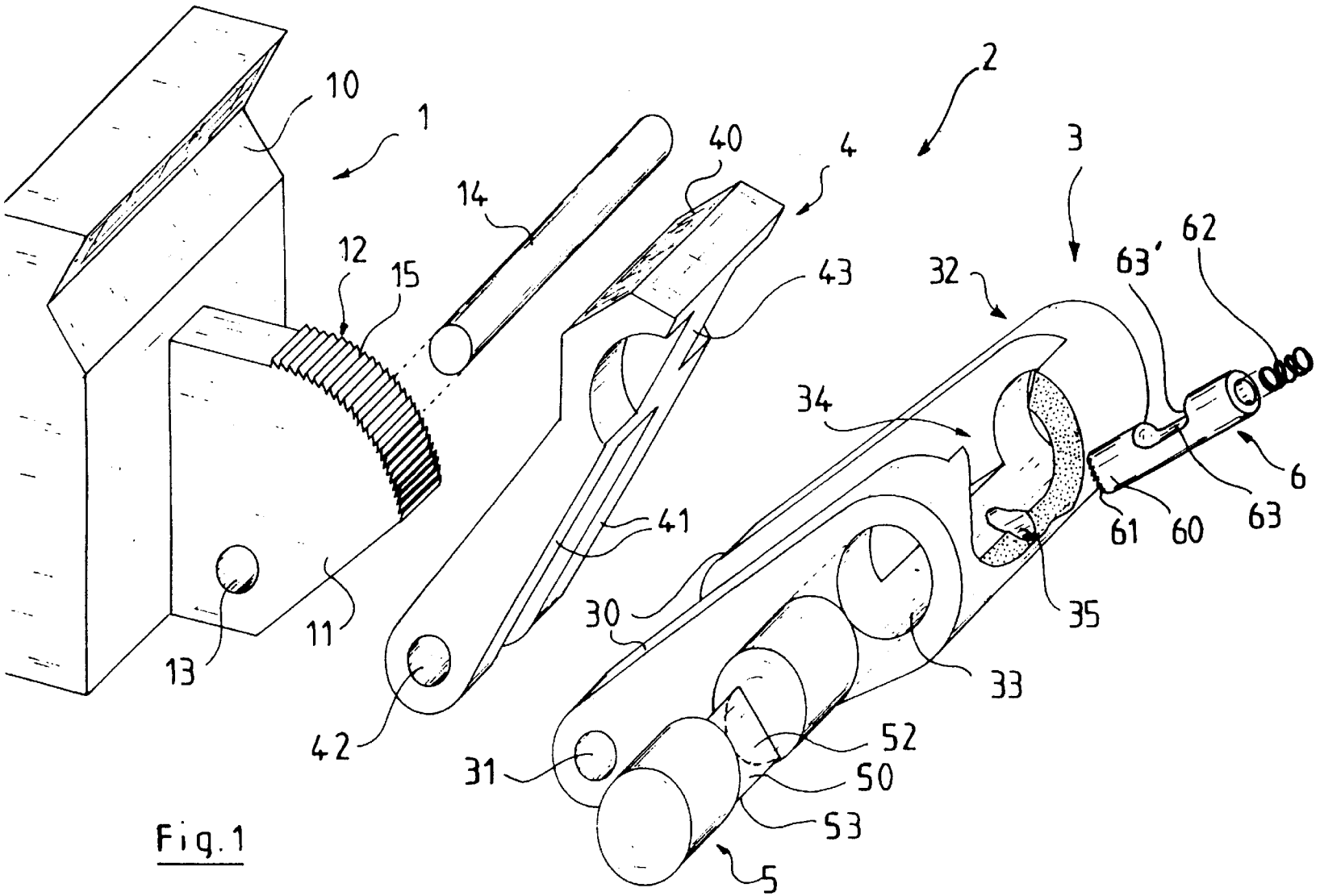
FIG. 1 is a perspective, exploded view, partially cross-sectioned, of a first method of production of the vice device of this invention.

If one refers to FIG. 1, one can see that a vice device of this invention consists of a frame 1 fixed by appropriate means, not represented, to a workbench, for example, and a mobile jaw 2 containing a body 3 and a mobile jaw 4. The frame 1 consists of a jaw 10 and, projecting out perpendicularly, a flat piece 11 of which the upper side is a rack 12 in the shape of circular arc concentric to a transversal hole 13 destined to form an axis for a pin 14 for the pivoting of the body 3 and of the mobile jaw 4.

The mobile jaw 4 contains a jaw part 40 and two branches 41 passing on both sides of flat piece 11. A hole 42, of which only one is visible, is pierced in each of the branches 41 for the passage of the pin 14. The body 3 contains two branches 30 passing on both sides of the branches 41 of the mobile jaw 4. In each of the branches 30, a hole 31, of which only one is visible, is pierced for the passage of the pin 14. The jaw 4 and the body 3 are spread by a spring, not represented, slid onto the pin 14 and pushing on the frame 1 and on the mobile jaw 4.

The body 3 contains at its free end a transverse canal 33 in which is introduced a shaft 5 mobile in rotation under the action of a lever, not represented, and which contains in its central region a cam 50 made up of a non-axial half circle. The canal 33 contains a central aperture 34 allowing the rear side 43 of the mobile jaw 4 to enter into contact with the cam 50. The body 3 also contains a deep canal 35, radial to the pin 14, in the interior and coming out between the branches 30 and partially passing by the canal 33 to the right of the cam 50, and in which a driver 6, in a generally cylindrical shape is lodged, of which the lower end 60 contains transverse teeth 61 in a shape complimentary to that of the teeth 15 in the rack 12.

The driver 6 is mobile in axial movement in the canal 35, and is pushed back in the direction of the rack 12 by a spring 62 pushing on the bottom 35', not visible in the canal 35. The driver 6 also contains an indentation 63 in its central region in which a part of the cam 50 is placed to allow the stopping of the rotation of the driver 6 in the canal 35.

Figure 2A:
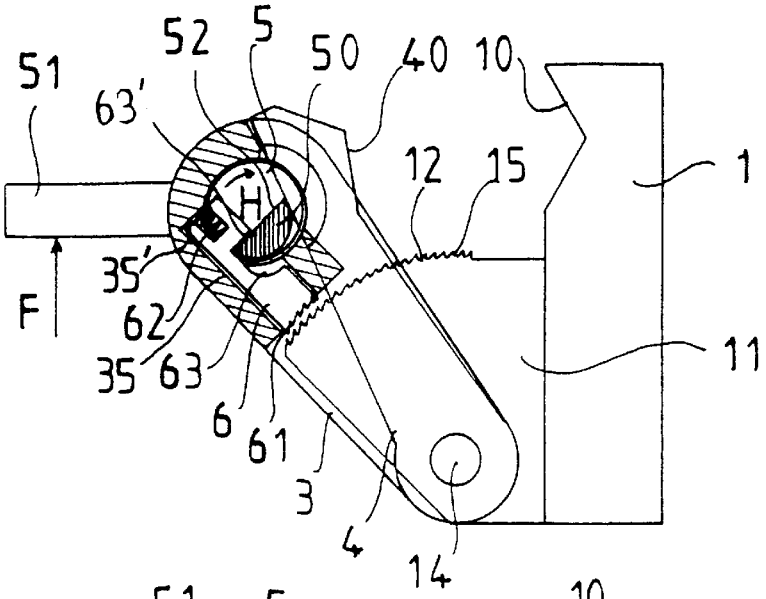
FIGS. 2*a*, 2*b*, and 2*c* are side elevation, schematic views of the same device during different phases of use.

If one refers now to FIG. 2*a*, one can see that during a thrust towards the top in the direction of arrow F, on such movement, lever 51 of the shaft 5 turns the shaft 5 in the direction of arrow H and the flat side 52 of the cam 50 enters into contact with the upper side 63' of the indentation 63, which leads to the rise of the driver 6 squeezing the spring 62 against the bottom 35', and the disengagement of the teeth 61 from the teeth 15.

Figure 2B:
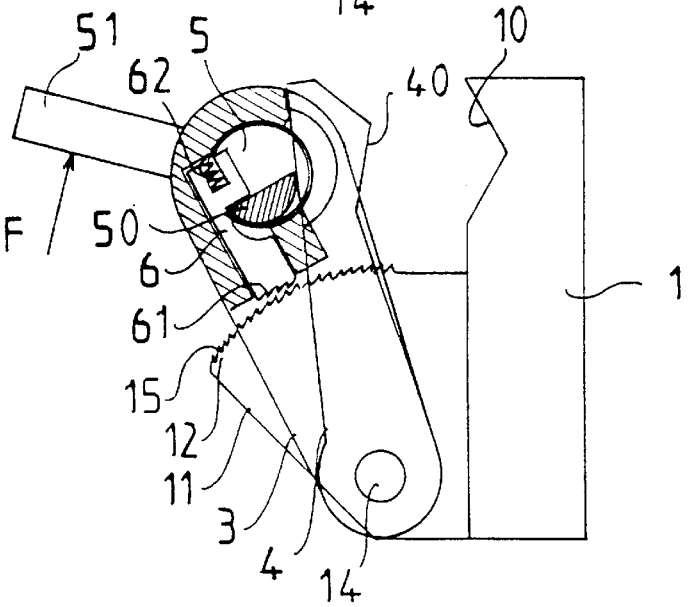

If one refers now to FIG. 2*b*, one can see that the prolonging of the thrust in direction of arrow F on the level 51 results in the pivoting of the body 3, which drives the mobile jaw 2, the jaw 40 of which comes closer to the jaw 10 of the frame 1.

Figure 2C:
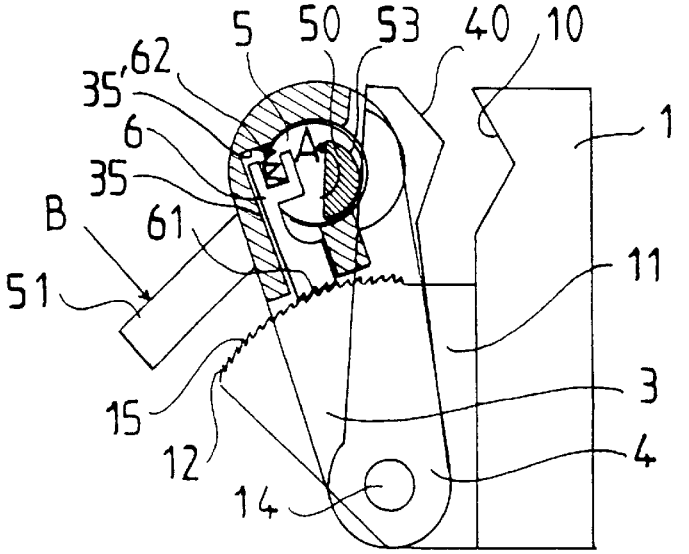

If one refers to FIG. 2*c*, one can see that the lessening of the thrust on the lever 51 leads, under action of the spring 62, to the descent of the driver 6 and the engaging of the teeth 61 of the driver in the teeth 15 of the rack, which locks the body 3 in a certain position, and that a thrust on the back, in the direction of arrow B, on the lever 51 makes the shaft 5 pivot in direction of arrow A, and curved side 53 of the cam pushes on the rear side 23 of the mobile jaw 2, which distances itself from the body 3 such that the jaw 40 gets nearer to the jaw 10 of the frame 1.

The displacement of the body 3 and its locking onto the rack 12 allow the holding of the object to be tightened between the mobile jaw 2 and the frame 1, and the displacement of the mobile jaw 2 under the action of the cam 50 allows the refinement of the tightening. The operation of tightening can, therefore, be easily and quickly achieved by holding the object to be tightened in one hand and by maneuvering the lever 51 with the other.

One will note the particular profiles of the jaws 10 and 40, both of which have a V-shape, concave for the jaw 10 of the frame and convex for the jaw 40. These profiles of these jaws 10 and 40 are more particularly adapted to the tightening of tubes.

Figure 3:
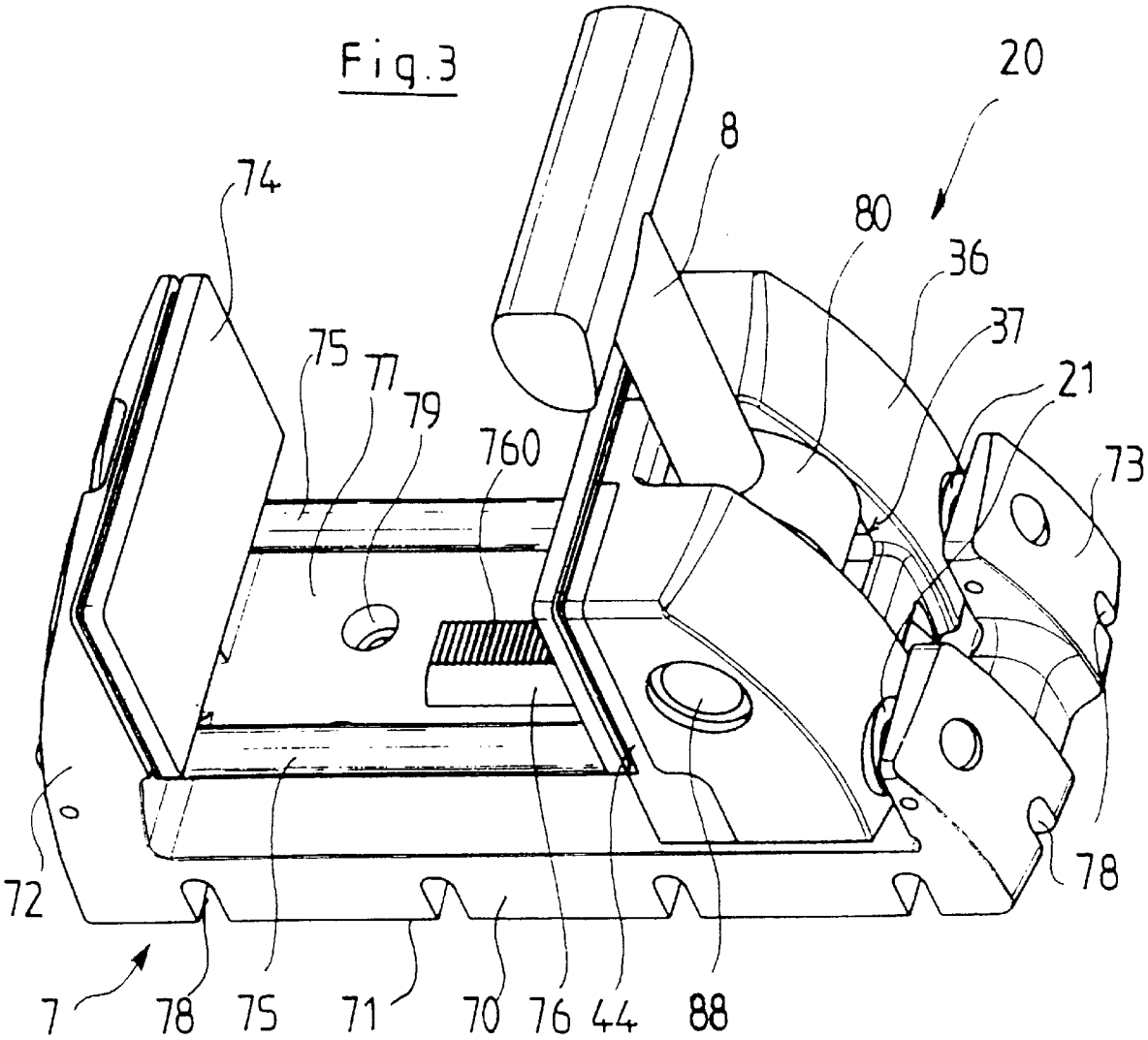
FIG. 3 is a perspective view of a second method of production of the vice device of this invention.
Figure 4:
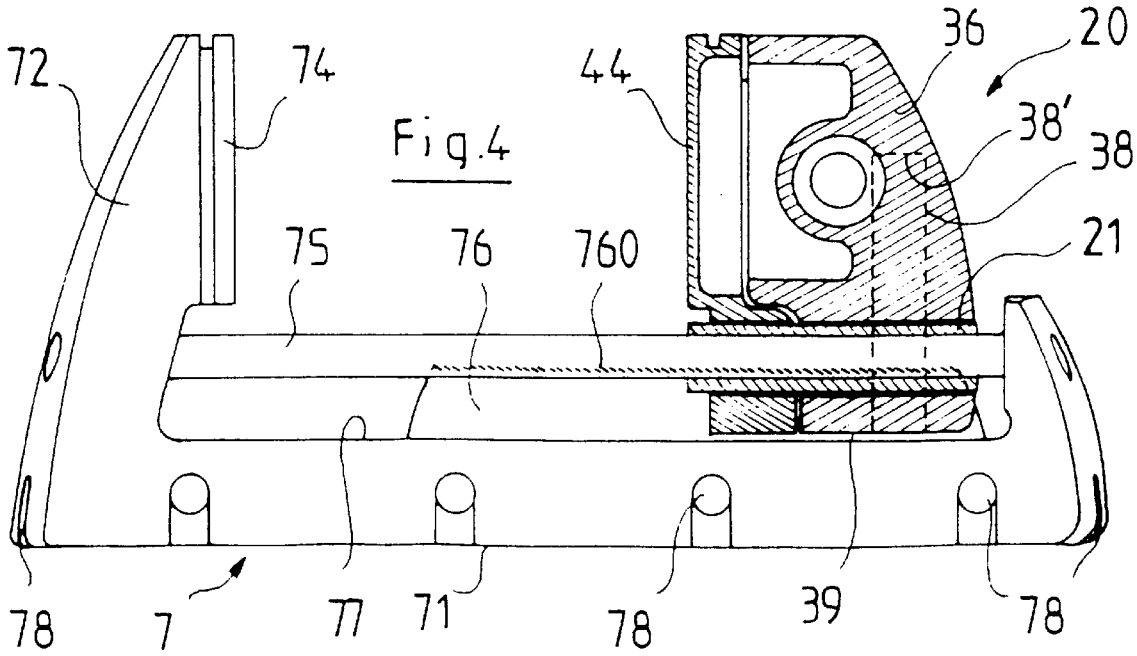
FIG. 4 is a side elevational view partially cross-sectioned along a vertical, longitudinal, non-median plane of the device shown in FIG. 4.

If one refers now to FIGS. 3 and 4, one can see that according to a second method of production, the vice device of this invention consists of a frame 7 containing a smooth rectangular base 70 destined to be fixed by its lower face 71 to a flat support, such as a table or workbench, and two vertical walls 72 and 73 opposite to each of the ends of the base 71, the wall 72 being higher than the wall 73 and carrying a jaw 74 on its interior face. Two parallel bars 75 having a round cross-section stretch between the walls 72 and 73 to which they are attached at their ends. A rack 76 having transversal cuts or notches 760 is fixed to the upper face 77 of the base 70 parallel to the bars 75.

The vice also contains a dolly 20 mobile by sliding on the bars 75 by means of tubular guides 21 of which only one is visible in FIG. 4. The dolly 20 consists of a body 36 and a jaw 44 parallel to the fixed jaw 74. The jaw 44 is mobile by sliding on the tubular guides 21 which are fixed to the body 36. The body 36 is crossed transversally by a pin 88, and contains a central opening 37 in which is engaged the end 80 of a lever 8, not represented on FIG. 4, which connects by pivoting on the pin 88.

Figure 5:
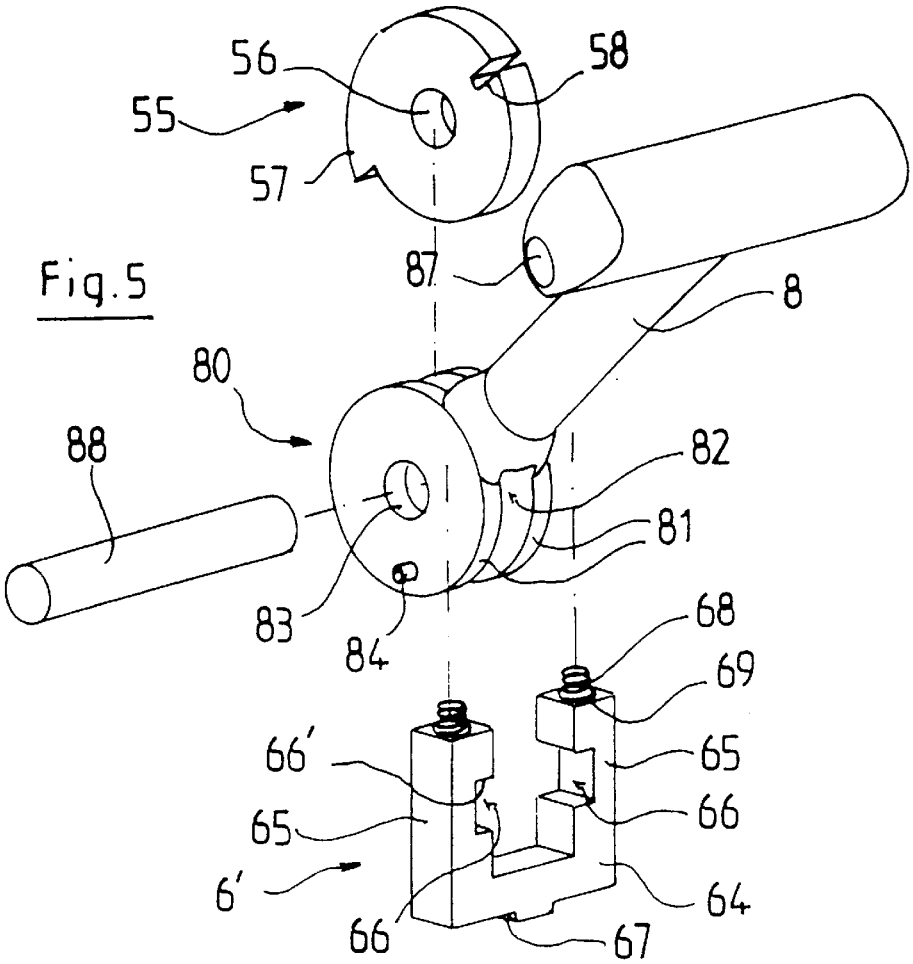
FIG. 5 is a perspective, exploded view of the device shown in FIG. 4.

If one refers now to FIG. 5, one can see that the end 80 of the lever 8 contains two coaxial disks 81 separated by a space 82 and pierced by a hole 83 for the passage of the axis 88. The space 82 is destined to receive a disk 55 containing a hole 56 for the passage of the pin 88, and introducing, on about one quarter of its circumference on the side of the jaw 44, a cam part 57. The radius of cam part 57 is not constant and increases from top towards the bottom. The disk 55 is in free rotation on the pin 88, but the lever 8 contains means to allow fixation, which will be described further on.

One can also see in FIG. 5 a driver 6' in the form of a stirrup containing a crosspiece 64 topped by two parallel upright poles 65 each having on their internal sides 25 an indentation 66 in a position roughly in the middle. The crossbar 64 has at its lower central side a series of notches 67 in a shape complimentary to that of the notches 760 of the rack 76, not represented. The driver 6' is destined to be introduced in a housing 38, which contains the body 36, represented by dotted lines in FIG. 4, opening on the lower face 39 of the part to the right of the rack 76, and positioned to the rear of the passage of the pin 88. The driver 6' can displace itself in the housing 38 in order to allow the engagement of notches 67 in the notches 760 of the rack 76, under the action of two springs 68 lodged in two holes 69 each pierced in the upper end of the upright parts 65 and which push against the bottom 38' of the housing 38.

The end 80 of the lever 8 also contains two lugs 84 projecting from each of the external faces of the disks 81 of which only one lug 64 is visible. The lugs 64 are destined to each fit into one of the indentations 66 of the driver 6'.

Figure 6A:
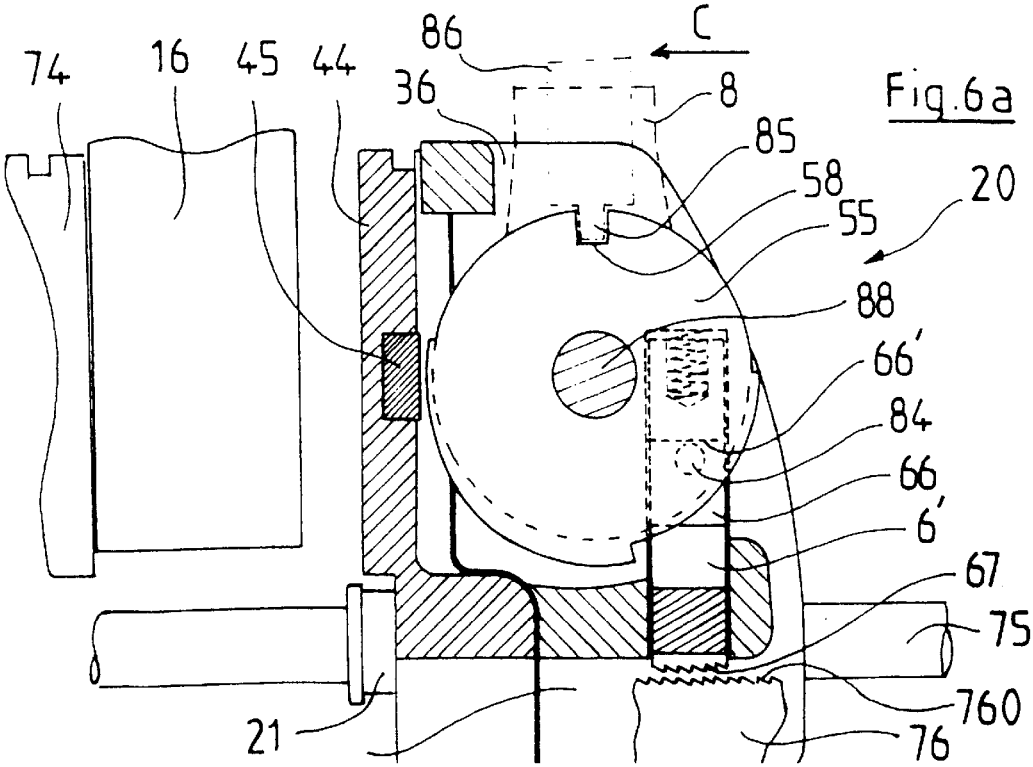
FIGS. 6*a*, 6*b*, and 6*c* are partial views along a longitudinal median plane of the device of FIG. 4 during different phases of use.
Figure 6B:
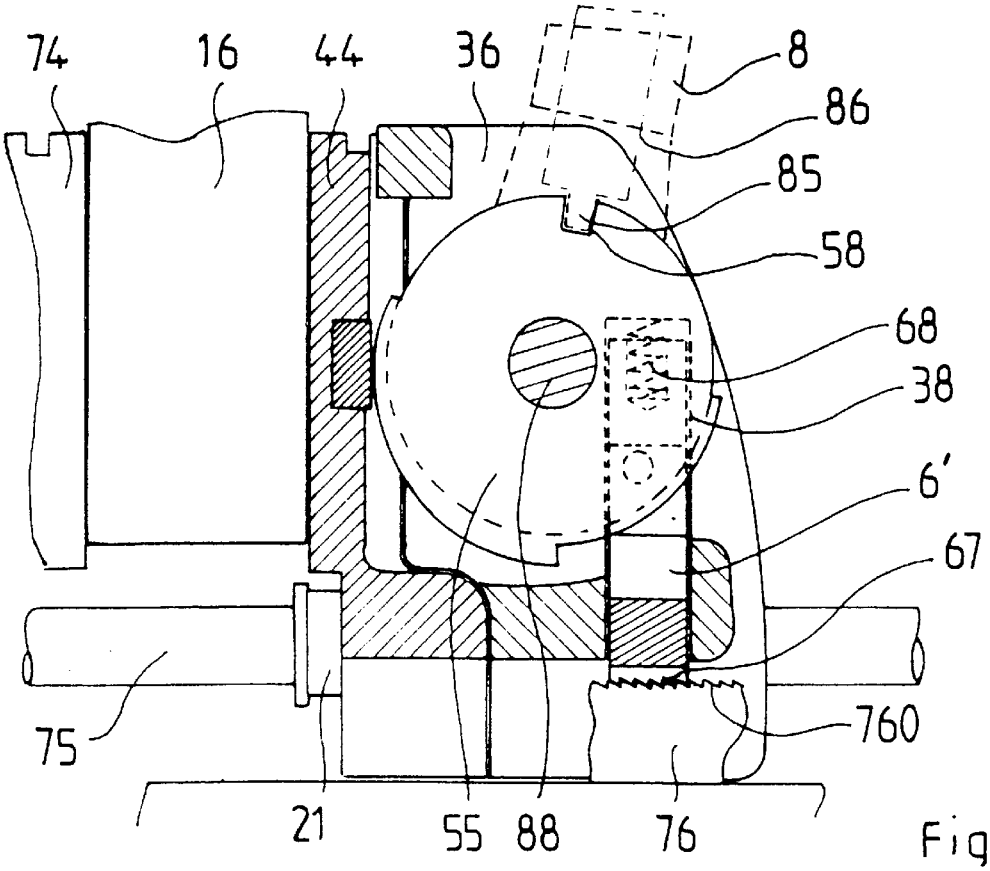
Figure 6C:
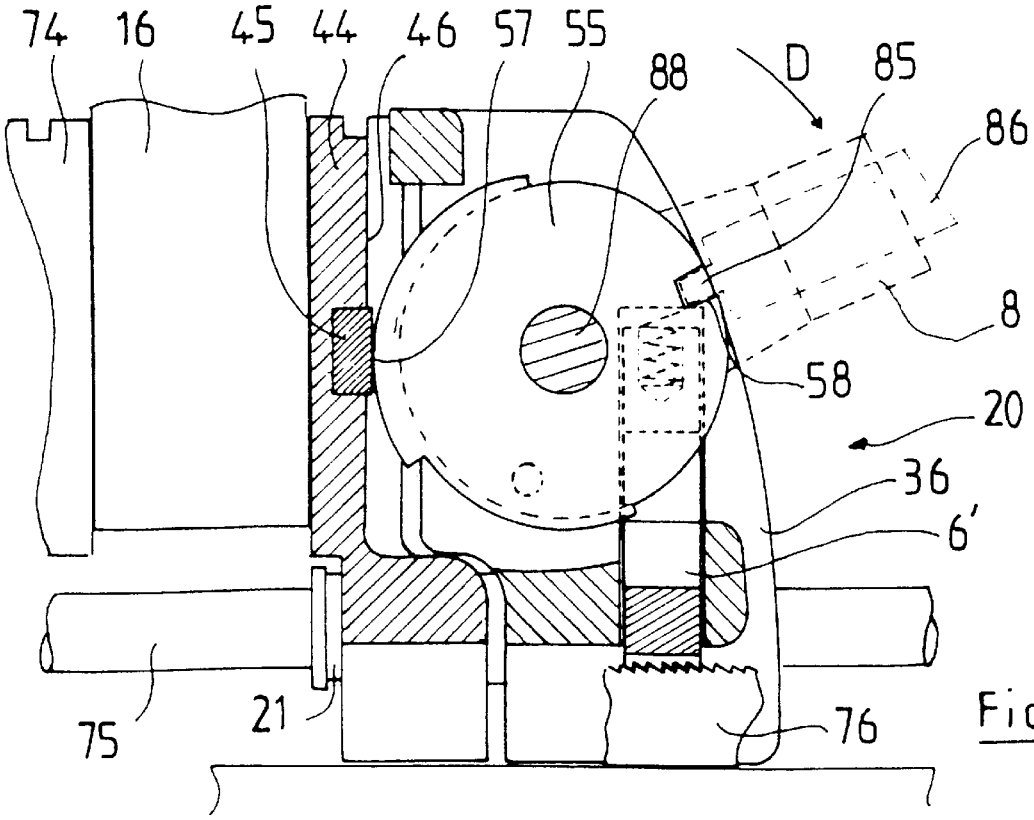

If one refers now to FIGS. 6*a*, 6*b*, and 6*c*, one can see the functioning of this embodiment of the vice device of this invention.

In FIG. 6*a*, when an object to be tightened 16 is placed against the fixed jaw 74, the dolly 20 is then dislodged in the direction of the fixed jaw 74, exercising a thrust on the lever 8 in the direction of the fixed jaw 74 in the direction of arrow C, until the jaw 44 comes into contact with the object 16. The pressure of the lever 8 in the direction of arrow C having the effect of, by means of the lugs 84 which lean on the upper sides 66' of the indentations 66, a rising of the driver 6' which squeezes the springs 68, which results in the disengagement of the notches 67 from the notches 760 of the rack 76.

In FIG. 6*b*, when the mobile jaw 44 is in contact with the object 16, the pressure on the lever 8 is relaxed, so that under the effect of the springs 68, the driver 6' slides into the housing 38 and the notches 67 engage with the notches 760 of the rack 76 to lock the dolly 20.

In FIG. 6*c*, the lever 8 is lowered in the direction of arrow D, which results in the rotation of the disk 55 of which the cam part 57 leans on a pin 45 which contains the jaw 44 on it rear face 46, and pushes back the jaw 44 which slides on the tubular guides 21 and tightens the object 16, the body 36 staying anchored against the rack 76.

In this method of production, the disk 55 is in free rotation on the pin 88, eventually being stopped by an appropriate means, such as a torque joint, not represented. The fixation of the disk 55 to the lever 8 is achieved by means of a lug 85, which contains at its end a rod 86 shown sliding axially on the lever 8, and likely to engage itself into an indentation 58 pierced in the side of the disk 55. The retraction of the lug 85 is achieved by a system of a known type, which will not be described, and controlled by a bottom 87, visible in FIG. 5, which contains the lever 8 at its free end.

After tightening the object 16, the lug 85 can be retracted and disengaged from the indentation 58, which permits the lowering of the lever 8 so as not to interfere with work on the object.

One will also note that the lever 51 and the shaft 5 of the first method of production can also be attached by a similar device.

According to a variance not represented, the device is able not to contain this adjustment. In this case, the end 81 of the lever 8 only contains the cam part 57, which is attached to it by means of a screw, for example.

Figure 7:
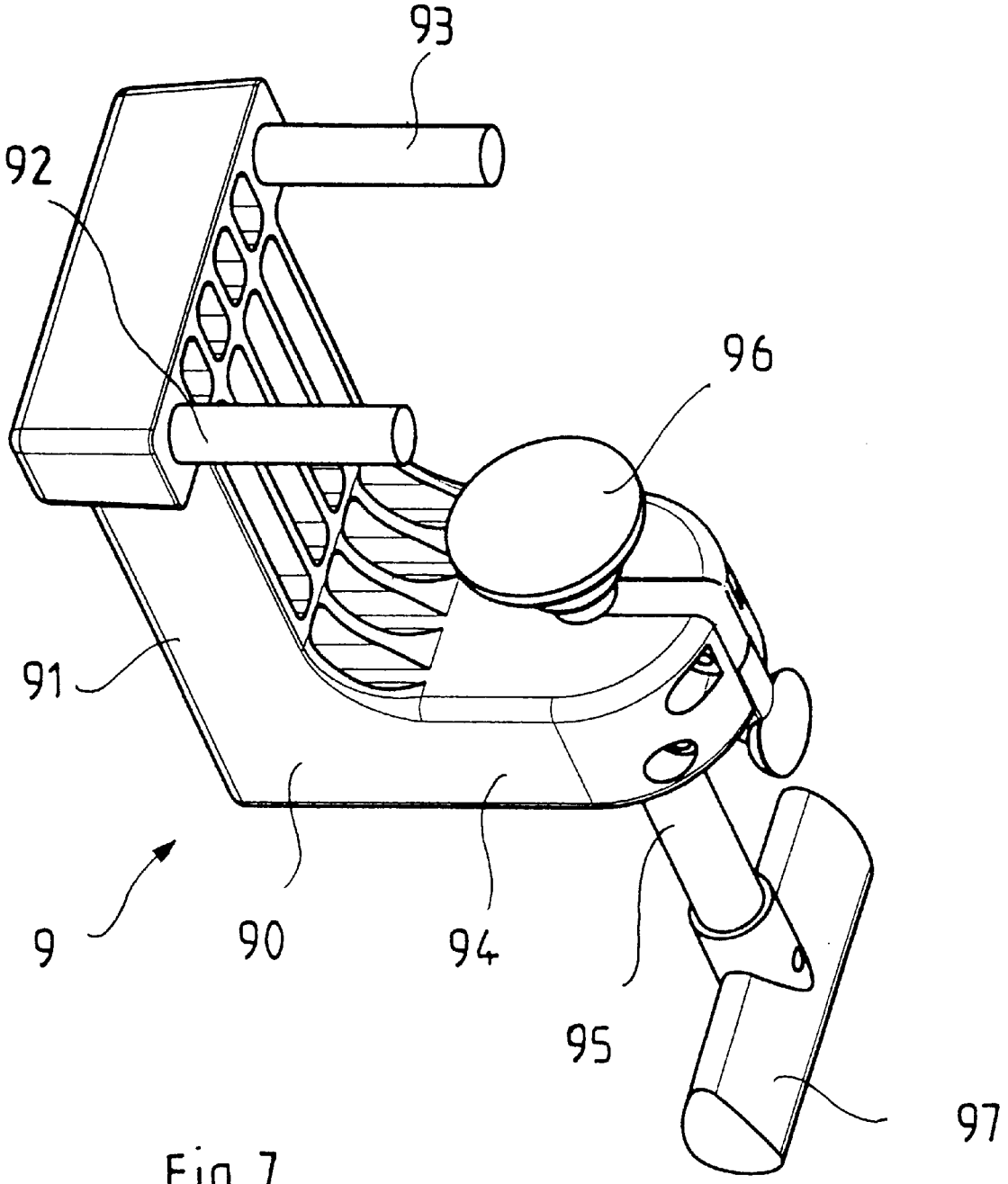
FIG. 7 represents a perspective view of a fastening device for the vice device of this invention.

If one refers now to FIG. 7, one can see a fastening device 9 of a vice device of this invention. This fastening device 9 consists of a body 90 in the shape of an L of which a branch 91 contains at its end two perpendicularly projecting, parallel rods 92 and 93. Another branch 94 is crossed perpendicularly by a screw 95 equipped at its lower end with a maneuvering handle 96 and at its other end with a flat tip 97. The rods 92 and 93 are destined to be introduced into two holes 78, visible in FIGS. 3 and 4, which contain regular spaces on the perimeter of the base 70, while the branch 94 of the body 90 is placed under the flat support, not represented, on which rests the base 70. Then the screw 95 is tightened until the flat tip 97 comes to rest against the lower face of the support. One will note that the frame 7 can also be attached onto a support by screws, by means of a screw introduced into the holes 79 pierced in the base 70, of which only one is visible in FIG. 3.

What is claimed is:

1. A vice device comprising:

a frame fixed onto a flat support and containing a fixed jaw and a rack, the rack disposed in a plane perpendicular to the fixed jaw;

a mobile jaw, including a body and a jaw part mobile in movement in relation to the body the jaw part including a posterior part, the jaw being mobile in movement in parallel to the rack and lockable onto the rack by means of a driver movably disposed in the body, the driver having notches at an end opposite to the rack and biased in the direction of the rack by at least one spring and maneuverable by a lever, the lever adjustably mounted on the body, the lever having an adjustable end attached to a cam which engages the posterior part of the jaw part in order to allow the spreading of the mobile jaw from the body in the direction of the fixed jaw.

2. The device according to claim 1 characterized by the body and the jaw part of the mobile jaw are mounted on a pin parallel to the fixed jaw, and the rack is in the form of a circular arc coaxial to the pin.

3. The device according to claim 2 characterized by the driver being disposed in a chamber radial to the pin of the mobile jaw (2), and biased in the direction of the rack by a spring, and the driver being linked to the cam in a manner such that the rotation of the cam in one direction allows the spreading of the jaw part from the body, and compresses the spring (62).

4. The device according to claim 1 characterized by the cam consisting of a half circle non-coaxial to a pivoting axis of which one part is placed in an indentation formed in a central region of the driver, a curved wall coming into contact with the jaw part, while the flat wall comes to rest against an upper side of the indentation.

5. The device according to claim 1 characterized by the fixed law and the mobile law having complementary profiles in the shape of a V, the fixed jaw of the frame being concave and the jaw part of the mobile jaw being convex.

6. The device according to claim 1 characterized by the mobile jaw being slidingly mounted in parallel to a rectangular rack by means of guides fixed to the body of the mobile jaw, the jaw part of the mobile jaw being slidingly mobile on the guides.

7. The device according to claim 6 characterized by the guides being tubular pieces which slide on parallel bars attached to the frame.

8. The device according to claim 6 characterized by the adjustable end of the lever containing two coaxial disks separated by a space and pierced by a hole for the passage of a pin onto the body, the space receiving a disk mounted in rotation on the pin fixed to the lever, and presenting, on approximately a quarter of its circumference a cam part, the radius of the cam part being non-constant and increasing from top to bottom.

9. The device according to claim 8 characterized by the driver being mobile in a housing formed in the body and opening to one side of the rack, the driver being in the shape of a stirrup containing a crossbar and two parallel upright supports, each containing at ends a back spring, and each presenting an indentation on internal sides in a position substantially in the middle;

the crossbar includes notches on a lower central side; and the adjustable end of the lever laterally containing lugs, each disposed in one of the indentations, the lugs coming to rest during the raising of the lever to squeeze the springs.

10. The device according to claim 1 characterized by the cam being attached to the lever by means of a retractable lug.

11. The device according to claim 1 characterized by the frame containing spaced holes on its perimeter;

a fastening device including two parallel rods introduced into two of the holes; and means, carried on the fastening device, for fastening the frame onto the flat support.

* * * * *